United States Patent [19]

Vaida

[11] Patent Number: 4,481,734

[45] Date of Patent: Nov. 13, 1984

[54] LOUVER ASSEMBLY

[76] Inventor: George J. Vaida, Guadalquivir 153, El Paraiso, Rio Piedras, P.R. 00926

[21] Appl. No.: 399,488

[22] Filed: Jul. 19, 1982

[51] Int. Cl.[3] ..... E06B 7/08

[52] U.S. Cl. ..... 49/92; 49/74; 160/236

[58] Field of Search ..... 49/92, 91, 74; 98/121 A; 160/236

[56] References Cited

U.S. PATENT DOCUMENTS

| | | | |
|---|---|---|---|
| 2,074,482 | 3/1937 | Martens | 160/236 |
| 2,592,888 | 4/1952 | Greegor | 160/236 |
| 3,123,098 | 3/1964 | Bishop | 49/92 X |
| 3,381,601 | 5/1968 | McCabe | 49/74 X |
| 3,460,289 | 8/1969 | Toth | 49/92 X |
| 4,199,898 | 4/1980 | Connor | 49/92 |

*Primary Examiner*—Philip C. Kannan
*Attorney, Agent, or Firm*—Ezra Sutton

[57] ABSTRACT

A louver assembly is provided which includes a frame having vertical side jambs, a head, a sill, and a central opening. A plurality of vertically-spaced, substantially-straight horizontal louver members extend across the opening between the side jambs, with each of the louver members including a closing section and an actuating section. Actuating means are attached to the actuating section of each of the louver members for actuating them between open and closed positions. In addition, sealing fins extend from the jambs, head, and sill to cover the peripheral portion of the central opening. Each of the louver members is pivotally mounted on the side jambs, so that when the louver members are in their closed positions, the louver members overlap the peripheral sealing fins, and the closing section of adjacent louver members overlap each other to tightly seal the louver assembly against inclement weather. Further, each of the actuating sections of the louver members form troughs directed to the exterior for drawing away any water which may penetrate the seals. In addition, the side jambs and the sealing fins cooperate with the louver members in their closed positions to form vertically-extending drainage channels connecting the troughs to provide additional drainage of water to the exterior. Finally, the louver members are pivotally mounted off center, with the closing section being larger than the actuating section. The closing section only is exposed to the exterior, such that exterior wind conditions tend to close the louver members more tightly.

9 Claims, 5 Drawing Figures

LOUVER ASSEMBLY

FIELD OF THE INVENTION

The present invention relates generally to louver assemblies and specifically to an improved louver assembly wherein the lower longitudinal edge of an upper louver member overlaps the pivot axis of the adjacent lower louver member, so that the upper and lower longitudinal edges of each louver member are completely supported by the pivot axes of adjacent louver members. In addition, the louver members are pivotally mounted off center so that exterior wind conditions tend to close the louver members more tightly against inclement weather and are provided with channel members for receiving glass inserts.

BACKGROUND OF THE INVENTION

Louver assemblies which include a plurality of vertically-spaced and horizontally-extending louver members are well known in the art. For example, U.S. Pat. No. 3,381,601 to McCabe discloses a louver assembly which is used as an air damper and includes a plurality of horizontally-extending louver slats which are pivotally mounted to be actuated between open and closed positions. In addition, the jambs, head, and sill are provided with fins to seal the peripheral edges of the assembly. However, in the '601 patent, the louver slats are mounted off center, so that the actuating section of each louver slat is much smaller than the closing section. In this manner, McCabe purposely balances each of the louver slats to permit ease of opening under wind-load conditions. This is contrary to the present invention. Also, in the '601 patent, the louver slats are not completely supported along their upper and lower longitudinal edges against opening, as in the present invention.

Accordingly, such prior art devices do not disclose mounting means for pivotally mounting the louver members, such that wind-load conditions operate to close the louver members more tightly, rather than permitting them to open more easily, and do not disclose means for providing complete support against opening for each louver member at its upper and lower edges. Moreover, such prior art arrangements do not disclose louver members which are constructed to cause any fluid which penetrates the closed louver assembly to flow away from the louver assembly.

Broadly, it is an object of the present invention to provide an improved louver assembly which overcomes one or more of the aforesaid problems. Specifically, it is within the contemplation of the present invention to provide a louver assembly wherein the individual louver members are each completely supported along their upper and lower longitudinal edges, as well as along their vertical edges, to prevent opening by inclement weather or by forced entry.

It is a further object of the present invention to provide an improved louver assembly wherein each of the louver members is pivotally mounted off center, so that exterior wind conditions tend to close the louver members more tightly against inclement weather.

SUMMARY OF THE INVENTION

Briefly, in accordance with the principles of the present invention, an improved louver assembly is provided which includes a frame having vertical side jambs, a head, a sill, and a central opening. A plurality of vertically-spaced, horizontal louver members extend longitudinally across the central opening between the side jambs, with each of the louver members including a closing section and an actuating section. Actuating means are attached to the actuating section of each of the louver members for pivoting them between open and closed positions. In addition, sealing fins extend from the jambs, head, and sill to cover the peripheral portion of the central opening. Each of the louver members is pivotally mounted on the side jambs, so that when the louver members are in their closed positions, the closing sections of adjacent louver members partially overlap each other, and the side edges of the louver members overlap the peripheral sealing fins to tightly seal the louver assembly against inclement weather.

More particularly, the reinforced pivot axes of adjacent louver members cooperate, so that each louver member is supported by two reinforced pivot axes, the first support being provided by the pivot axis for that louver member along its upper longitudinal edge, and the second support being provided along its lower longitudinal edge by the pivot axis of the next lower louver member, so that each louver member is completely supported against bowing, inclement weather, and forced entry.

In a preferred embodiment, a portion of each louver member is removed, and channels are provided for receiving glass inserts to allow light to pass therethrough, without affecting the supporting means at the upper and lower longitudinal edges of the closing section of each louver member.

In addition, the louver members are pivotally mounted off center, so that the closing section is larger than the actuating section, such that exterior wind conditions actually help to close the louver members more tightly against inclement weather.

Finally, each of the actuating sections of the louver members is constructed to form a trough when in their closed positions which causes any fluid that penetrates the seal of the louver assembly to flow away from the louver assembly. Further, the side jambs and the sealing fins cooperate with the louver members in their closed positions to form vertically-extending drainage channels connecting the ends of the troughs to provide drainage of fluid away from the troughs. In addition, the vertically-extending drainage channels are connected to the sill, and the sill is constructed to form a trough to drain fluid away from the louver assembly.

Advantageously, the peripheral sealing fins in combination with the novel drainage features of the louver assembly of the present invention cooperate to provide a louver assembly which is completely weather tight under heavy storm conditions. More particularly, any fluid which penetrates the louver members or peripheral sealing fins is collected in the troughs of each of the louver members. As such troughs are constructed to cause any fluid which penetrates the seal to flow away from the louver assembly, the troughs prevent any penetrating fluid to enter the interior of the dwelling. Moreover, in order to prevent a large amount of fluid from accumulating in the troughs of each of the louver members, the vertically-extending drainage channels connected to the ends of the troughs provide an additional drainage feature to drain fluid away from the troughs and the louver assembly. Advantageously, the vertically-extending drainage channels are connected to the sill which is constructed to form a trough and to also drain fluid away from the louver assembly. In this manner, it is virtually impossible for any fluid which penetrates the seal of the louver assembly to accumulate in the troughs and enter the interior of the dwelling.

A further advantage of the present invention is that by mounting the louver members off center, the exterior wind conditions operate to close the louver members more tightly against inclement weather. That is, all of the exterior wind-load conditions are directed against the closing section of each of the louver members so that the wind-load itself tends to maintain the louver members closed and to insure that the sealing means are most effective to provide a completely weather-tight louver assembly.

BREIF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF PREFERRED EMBODIMENT OF THE INVENTION

Figure 1:
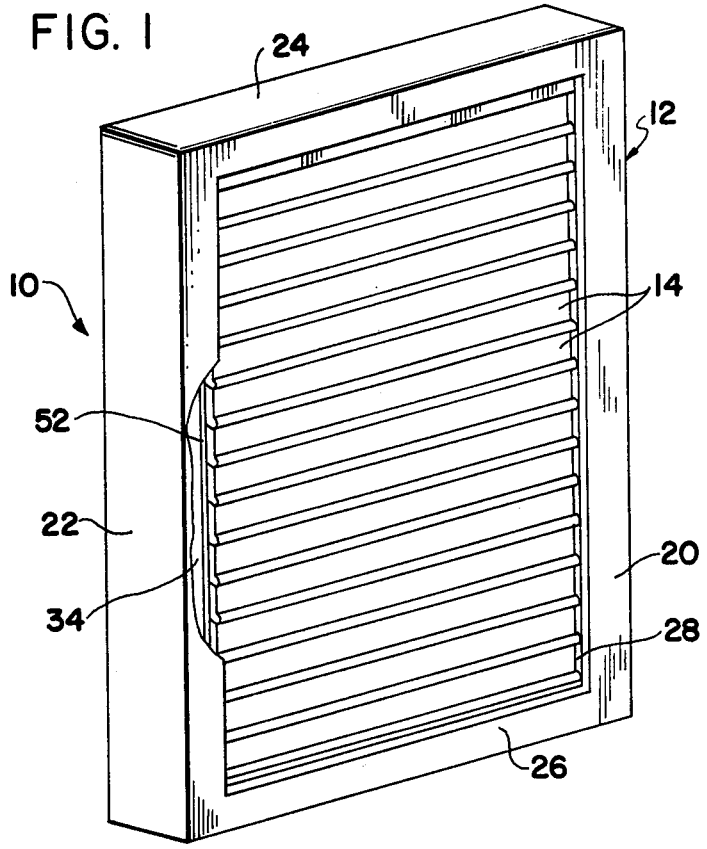
FIG. 1 is a perspective view of a louver assembly embodying the features of the present invention.

For purposes of disclosure, the invention herein is illustrated as being embodied in a window 10 having a metal frame 12 with a plurality of pivotally-mounted louver members 14 mounted for adjustment by an actuator 16 (see FIG. 3) which operates to simultaneously pivot each of the louver members about horizontal axes 18 so as to open or close the window or louver assembly 10. The metal frame 12 comprises vertical side jambs 20, 22, a head 24, and a sill 26 that are formed in the present embodiment primarily from metal extrusions and which are rigidly connected to each other. Weather stripping, such as shown at **22*b***, may also be employed at various locations, if desired.

Louver members 14 are vertically spaced and are substantially straight and extend longitudinally across the central opening 28 between the side jambs 20, 22. Each of the louver members 14 includes a closing section 30 and an actuating section 32, and each closing section 30 includes an upper longitudinal edge **30*a* and a lower longitudinal edge 30*b*. Each louver member 14 rotates about its hub axis 18 which is held in place by a steel rod 60 (see FIG. 4) or rivets 62 (see FIG. 5) that extend into a hole 22*a* formed in side jamb 22 and a corresponding hole 20*a* (not shown) formed in side jamb 20**.

Sealing fins 34 extend from side jambs 20, 22, and a sealing fin 36 extends from head 24, and a sealing fin 38 extends from sill 26 to cover the peripheral portion of central opening 28. In this manner, sealing fins 34, 36, and 38 form a substantially continuous sealing member about the periphery of central opening 28 which, as will be explained herein, cooperate with louver members 14 when in their closed positions to seal the louver assembly 10 in a weather-tight condition.

Figure 3:
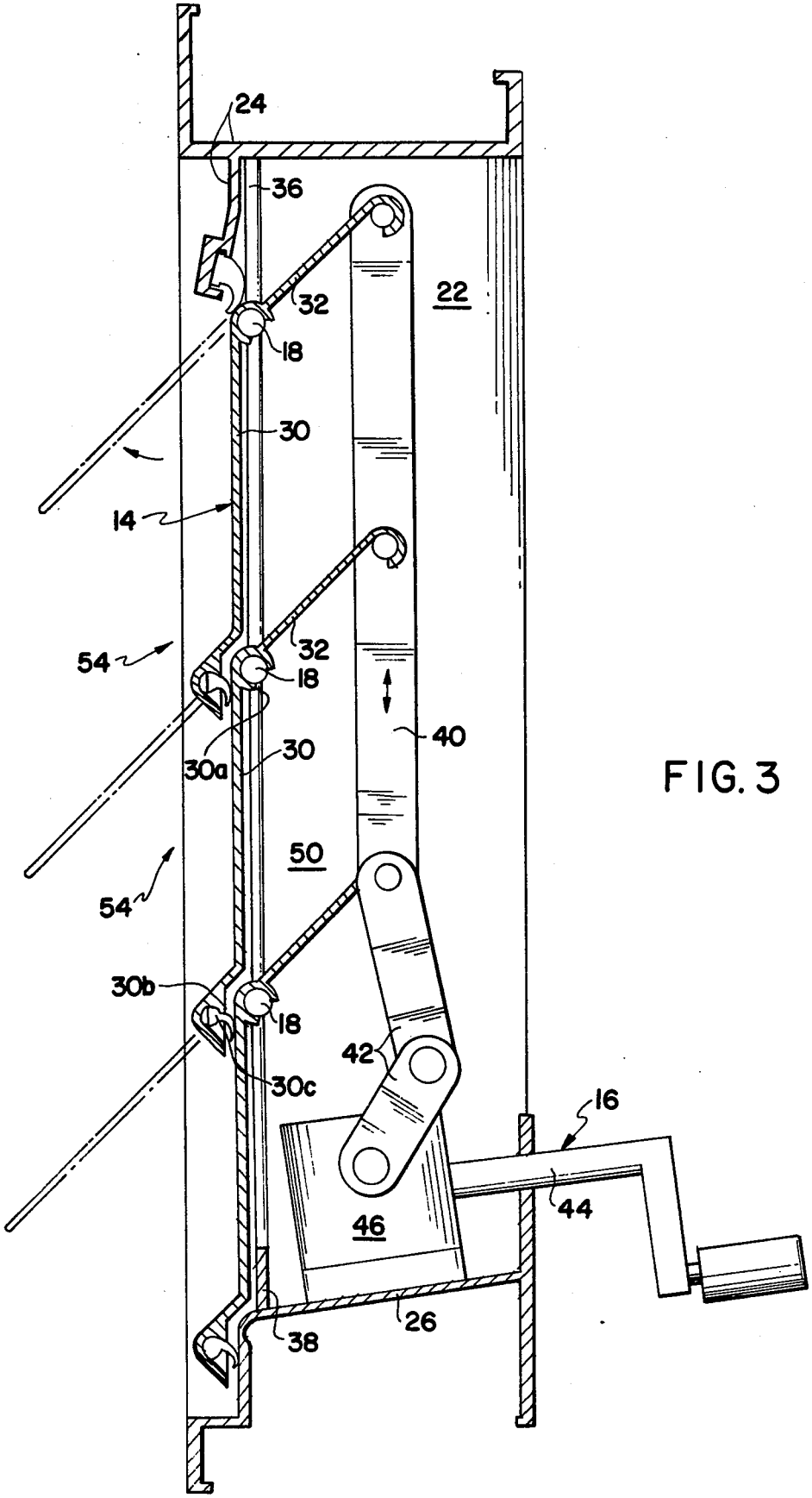
FIG. 3 is a sectional view, illustrating the louver members and actuating means therefore in detail.

Actuating means 16 are attached to the actuating section 32 of each of the louver members 14 for pivoting the louver members between open and closed positions. More particularly, each of the actuating sections 32 is connected to a vertically-extending actuating member 40 which, as shown most clearly in FIG. 3, is connected to pivotal links 42. A crank 44 and a gearbox 46 are operatively connected to links 42 and actuating member 40 to simultaneously pivot louver members 14 about their respective axes 18 between open and closed positions in a conventional manner.

Each of the longitudinally-extending lower edges **30*b* has weather stripping 30*c* mounted therein. In addition, the side edges 30*d* of the closing section of each of the louver members are constructed to overlap a portion of sealing fins 34 mounted on respective side jambs 20, 22. In this manner, when louver members 14 are in their closed positions, the lower edge 30*b* of each closing section 30 partially overlaps the closing section 30 of the adjacent lower louver member 14 to securely seal the louver members relative to each other. In addition, when the louver members 14 are in their closed positions, the side edges 30*d* of each louver member 14 overlap the peripheral sealing fins 34 of the side jambs 20, 22** to tightly seal the louver assembly relative to the frame and thereby securely seal the louver assembly against inclement weather.

In addition, each of the actuating sections 32 of louver members 14 is constructed to form a trough when in their closed positions, which causes any fluid which penetrates the seal of the louver assembly to flow away from the louver assembly. That is, as shown in FIG. 3, each of the actuating sections 32 cooperates with the closing section 30 of an adjacent louver member 14 to form a substantially V-shaped trough 50 when the louver members 14 are in their closed positions. As a result, any fluid which penetrates the seal between adjacent louver members is collected in troughs 50 and is prevented from entering the interior of the dwelling.

Figure 2:
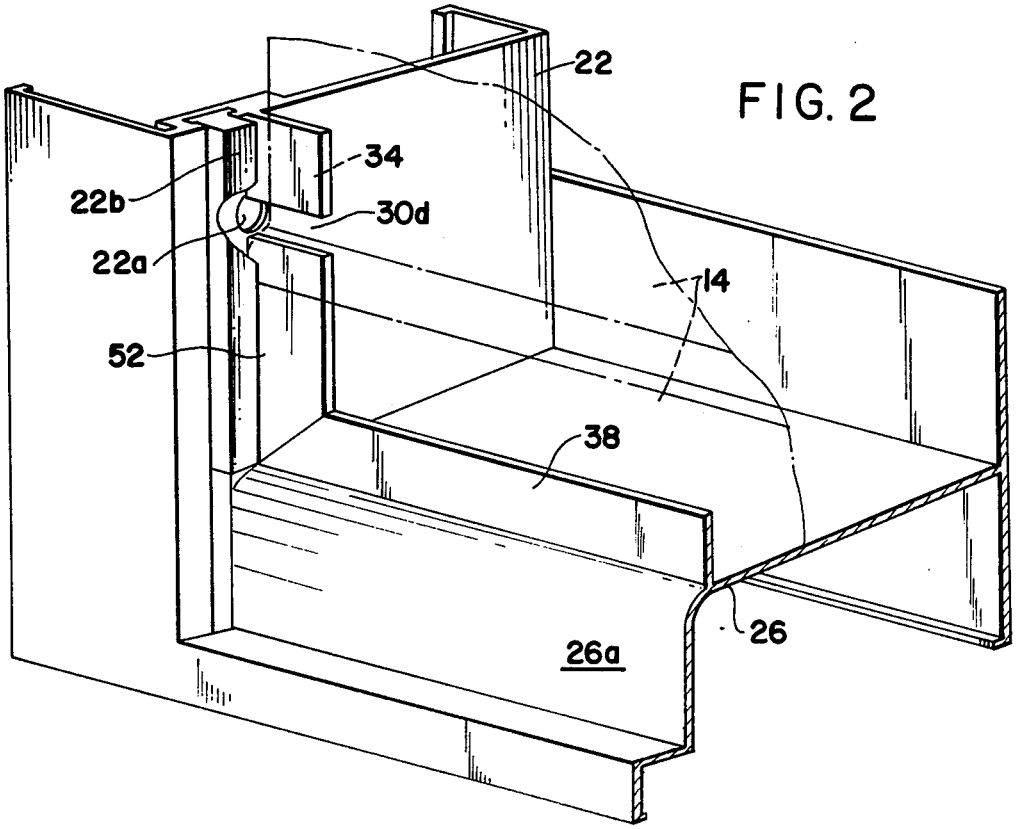
FIG. 2 is a perspective view, partially broken away, illustrating in detail the sealing fins and vertically-extending drainage channels of the present invention.

As shown most clearly in FIG. 2, it should also be noted that side jambs 20, 22 and respective side-sealing fins 34 cooperate with louver members 14 when in their closed positions to form vertically-extending drainage channels 52 connecting the ends of troughs 50 to provide drainage of fluid away from troughs 50. Such vertically-extending drainage channels 52 are connected to lower sill 26, the front portion **26*a* thereof being constructed to form a trough for the collection of fluid from vertically-extending drainage channels 52. In this manner, any fluid which accumulates in troughs 50 will flow via vertically-extending drainage channels 52 to lowermost trough 26*a* formed on sill 26, and such fluid will be drained away from louver assembly 10 and thereby prevent any fluid which penetrates the seal between adjacent louver members 14** from flowing into the interior of the dwelling.

It should also be noted that each of the louver members 14 is mounted off center with respect to frame 12, so that the closing section 30 of each louver member is larger than its actuating section 32. In this manner, when louver members 14 are in their closed positions, the exterior wind-load conditions are directed against closing sections 30, as illustrated by arrows 54, and the wind-load itself operates to maintain louver members 14 in their closed positions and also operates to close louver members 14 more tightly against inclement weather.

Figure 4:
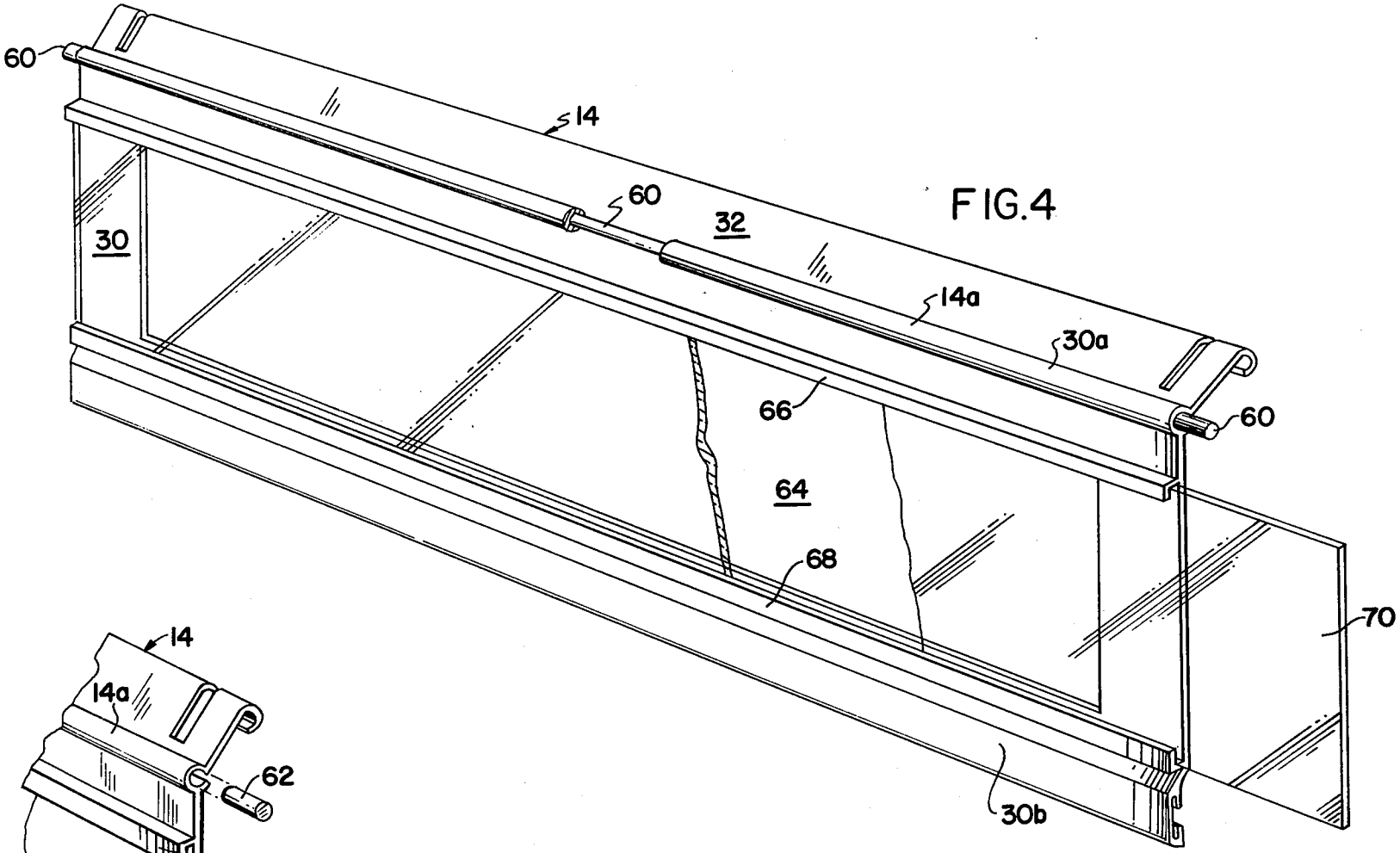
FIG. 4 is another embodiment of a louver member adapted to receive a glass insert.
Figure 5:
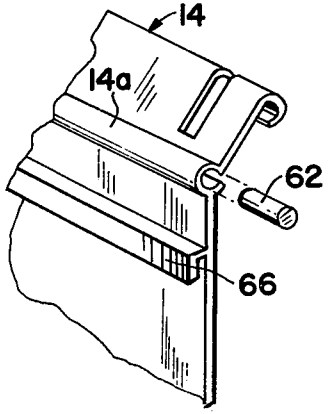
FIG. 5 is a detail view of a louver member having a reinforcing bead adapted to receive supporting rivets.

Referring now specifically to FIGS. 4 and 5, there are shown two alternative means for supporting each louver member. As shown in FIG. 4, a steel rod 60 extends through the pivot axis 18, which is formed by a bead member 14*a* formed in the louver. Alternatively, as shown in FIG. 5, rivets 62 may be employed at each end of the bead member 14*a* for pivotally supporting each louver member.

In this manner, the bead member 14*a* at the pivot axis 18 of each louver member provides reinforcing means at the upper longitudinal edge 30*a* of the closing section of each louver member. In addition, as pointed out above, the lower longitudinal edge 30*b* of each louver member is adapted to overlap the reinforced pivot axis 18 or bead member 14*a* of the adjacent lower louver member. In this manner, the upper and lower longitudinal edges 30*a*, 30*b* of each louver member are completely supported along their entire lengths by the two adjacent pivot axes 18.

As pointed out above, each pivot axis 18 is reinforced by having bead member 14*a* formed therein, and may be further reinforced by providing steel rod 60 extending completely through the hollow bead member 14*a*. When such a steel rod 60 is employed, it is preferable to employ nylon bushings between the steel rod 60 and the bead member 14*a* to prevent a deteriorating reaction between these members.

In this manner, the reinforced pivot axis 18 of each louver member provides additional strength and rigidity to each louver member to prevent bowing of the louver member and to provide additional security against forced entry, since it is virtually impossible to break through the louver members when they are completely supported along their upper and lower longitudinal edges 30*a*, 30*b* by the reinforced bead members 14*a*.

Tests have also been made with regard to wind conditions, and a louver assembly having the reinforced bead members 14*a* was tested successfully and withstood 170 mile/hour winds. It is also clear that when a steel rod 60 is employed, as shown in FIG. 4, such an arrangement would even further increase the strength of the louver assembly, and could also be used in high-crime areas as a deterrent for preventing break-ins and the like. It should also be noted that the V-shaped configuration of each louver member 14 adds to its rigidity and strength, which is further increased by having the bead member 14*a* provided therein.

As also shown in FIG. 4, a portion of the closing section 30 of the louver member may be deleted to form a cut out 64, and longitudinally-extending channel members 66 and 68 may be formed on the outer surface of the closing section of the louver member. These channel members 66, 68, in the preferred embodiment, are extruded with the entire louver member 14. A glass insert 70 is then adapted to be slidingly received within longitudinally-extending channel members 66, 68. In this manner, by having the cut out section 64 formed in the louver members, light is allowed to pass through the louver assembly without substantially affecting the rigidity and strength of each louver member. In fact, the longitudinally-extending channel members 66, 68 operate in a manner similar to bead member 14*a* in providing additional strength and rigidity to the louver member to prevent bowing thereof.

In view of the foregoing, it should be clear that as a result of the present invention, an improved louver assembly has been provided which has additional strength and rigidity, which is completely weather tight, and which is useful to prevent break-ins in high-crime areas.

A latitude of modification, change, and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. A louver assembly comprising:

a frame including vertical side jambs, a head, a sill, and a central opening;

a plurality of vertically-spaced, substantially-straight horizontal louver members extending longitudinally across said central opening between said side jambs, each of said louver members including a closing section and an actuating section, and each of said closing sections including upper and lower longitudinal edges;

means for pivotally mounting each of said louver members on said side jambs about respective pivot axes;

actuating means attached to the actuating section of each of said louver members for pivoting said louver members between open and closed positions, so that in said closed position, the lower longitudinal edge of an upper louver member overlaps the pivot axis of the adjacent lower louver member so that the upper and lower longitudinal edges of the closing section of said louver members are completely supported along their longitudinal lengths by said pivot axis at the upper longitudinal edge thereof and by the pivot axis of the adjacent lower louver member at the lower longitudinal edge thereof;

in said closed position, each of said actuated sections form a trough which receives any fluid which penetrates said louver assembly; and said side jambs cooperate with said louver members in their closed positions to form vertically extending drainage channels connecting the ends of said troughs to provide drainage of fluid away from said troughs.

2. A louver assembly in accordance with claim 1 wherein each of said means for pivotally mounting said louver members is mounted off center with respect to said louver members so that said closing section is larger than said actuating section, such that exterior wind conditions operate to close said louver members more tightly against inclement weather.

3. A louver assembly in accordance with claim 1 wherein each of said actuated sections are constructed to form a trough when in said closed position which causes any fluid which penetrates said louver members to flow away from said louver assembly, said trough formed between the actuating section of one louver member and the closing section of an adjacent louver member.

4. A louver assembly in accordance with claim 1 wherein each of said pivot axes includes reinforcing means.

5. A louver assembly in accordance with claim 4 wherein said reinforcing means of the pivot axis of each of said louver members includes a steel reinforcing member.

6. A louver assembly in accordance with claim 4 wherein said reinforcing means of the pivot axis of each of said louver members includes a reinforcing bead member.

7. A louver assembly in accordance with claim 6 wherein said reinforcing bead member is hollow for receiving supporting rivets at each end thereof for supporting said louver member on said vertical side jambs.

8. A louver assembly in accordance with claim 1 wherein at least one of said louver members is provided on its closing section with longitudinally-extending channel members adapted to slidingly receive inserts within said longitudinally-extending channel members.

9. A louver assembly in accordance with claim 8 wherein said at least one of said louver members has a portion of its closing section deleted to allow light to pass therethrough, said deleted portion adapted to be covered by said insert.

* * * * *